United States Patent [19]

Vierimaa

[11] 4,248,427

[45] Feb. 3, 1981

[54] ROTATING SURFACE PINBALL GAME

[76] Inventor: Donald W. Vierimaa, 5512 Harvey La., Alexandria, Va. 22312

[21] Appl. No.: 20,513

[22] Filed: Mar. 14, 1979

[51] Int. Cl.[3] ..... A63B 67/14

[52] U.S. Cl. ..... 273/110; 273/113; 273/115; 273/116; 273/125 R

[58] Field of Search ..... 273/110, 113, 115, 116, 273/121 A, 127 C, 125 R

[56] References Cited

U.S. PATENT DOCUMENTS

| | | | |
|---|---|---|---|
| 677,905 | 7/1901 | Tribble | 273/119 R |
| 1,291,105 | 1/1919 | Parker | 273/110 |
| 2,087,198 | 7/1937 | Chambers | 273/110 |
| 3,384,374 | 5/1968 | Boothe | 273/116 X |
| 3,751,038 | 8/1973 | O'Keffe | 273/110 |
| 3,854,724 | 12/1974 | Abraham | 273/125 R |
| 4,055,344 | 10/1977 | Soucie | 273/110 |

*Primary Examiner*—Robert L. Lindsay, Jr.

[57] ABSTRACT

A pinball type game utilizing an inclined, rotatable playing surface containing projections, guide rails, targets, traps, and at least one ball is described. The speed and direction of rotation of the playing surface is controlled by the player. The location and movement of the playing surface projections may be used to impart direction and speed to the playing ball. Barriers may be placed between some of the projections, thus aiding or hindering the ball striking a target or a trap. One or more ball propellers may be located on the playing surface to give the ball more action. Where holes are used as targets and traps, a means is provided to guide the ball dropping through a target or trap hole to channels which indicate the score obtained.

5 Claims, 7 Drawing Figures

ROTATING SURFACE PINBALL GAME

BACKGROUND OF THE INVENTION

1. Field of the Invention

This invention relates to improvements in pinball type games.

2. Brief Description of the Prior Art

Prior art pinball games consisted of inclined playing surfaces where the ball was projected to the top of the inclined surface using a plunger, usually spring activated. This invention uses the rotation of the playing surface and a projection at or near the periphery of the playing surface to carry the ball near and toward the top of the playing surface.

Prior art pinball games using a rotating playing surface used targets in the center or sides of the playing surface to capture the ball which resulted in a score. This invention permits targets and traps to be located almost anywhere on the playing surface when the targets and traps are electrically activated or at various radii from the center of the playing surface when the targets are holes.

The term "trap" as used in this application means an object one wishes to avoid and therefore takes on a meaning the opposite of "target" which is an object one wishes to strike. Where striking a target may result in a positive score, striking a trap may result in no score or a negative score.

Prior art pinball games using a ball propeller powered the propeller with electricity. The ball propeller used in this game achieves its power from the player rotating the playing surface.

Prior art pinball games utilized passive projections or projections placed to make striking a target more difficult. This invention utilizes projections to actively direct the ball.

SUMMARY OF THE INVENTION

It is an object of this invention to provide a simple game requiring mental strategy and manipulative skill which will provide the player with satisfaction.

One feature of the game is the means of rotating the playing surface with a ball transporting projection at or near the periphery of the playing surface to bring the ball near and towards the top of the inclined playing surface.

A second feature of the game is a guide rail, which may be combined with a ball transporting projection, to guide a ball traveling along the edge of the playing surface towards the inside or center of the playing surface or towards a ball propeller, target, trap, or other object.

A third feature of the game when the targets and traps are holes in the playing surface is that holes, whether targets or traps, of equal value are located at equal radii from the playing surface center of rotation which enables an inclined surface with raised concentric rings under the playing surface to catch balls dropping through the target or trap holes to be directed to channels corresponding to their scoring values. In addition to a visual score indication, chimes, bells, buzzers, or similar devices may be used to indicate a score attained.

A fourth feature of the game is the means of driving the ball propellers by the player rotating the playing surface. The ball propellers are driven by contact between the raised rings under the playing surface, which are concentric with the center of rotation of the playing surface, and the shaft of the ball propellers. The shaft of a propeller may be fitted with a rubber wheel, gear, or similar device.

A fifth feature of the game is the utilization of the projections located on the playing surface to direct the ball when the playing surface is rotated by the player.

A sixth feature of the game is the capability to change the play of the game through the placement of barriers between a number of equidistant positioned posts.

BRIEF DESCRIPTION OF THE DRAWINGS

FIG. 5A is a top plan fragment detail. FIG. 5B is a cross section fragment view along the lines B—B of FIG. 5A.

DETAILED DESCRIPTION

Figure 1:
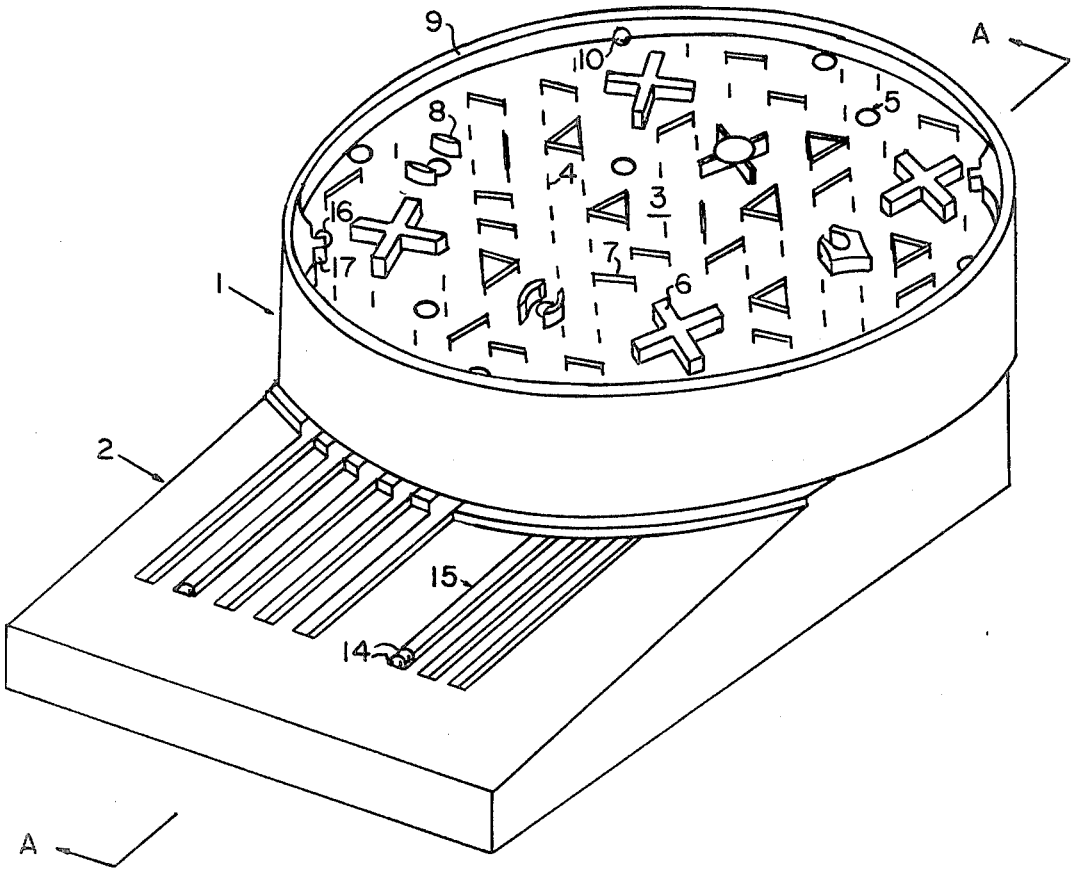
FIG. 1 is a general perspective view of the game.

The pinball game of the present invention consists of a revolving platform 1 supported by a stationary platform 2.

The revolving platform consists of a flat playing surface interspersed with posts 4, targets and traps which may be in the form of holes 5, ball propellers 6, and/or other types of projections. Some of the posts are equally spaced to allow a rubber band 7 or other barrier to be placed across two or more posts. Some of the targets and traps may have barriers 8 nearby. The playing surface 3 is surrounded by a raised surface 9 which keeps the playing ball 10 or similar object within the playing surface 3.

Figure 2:
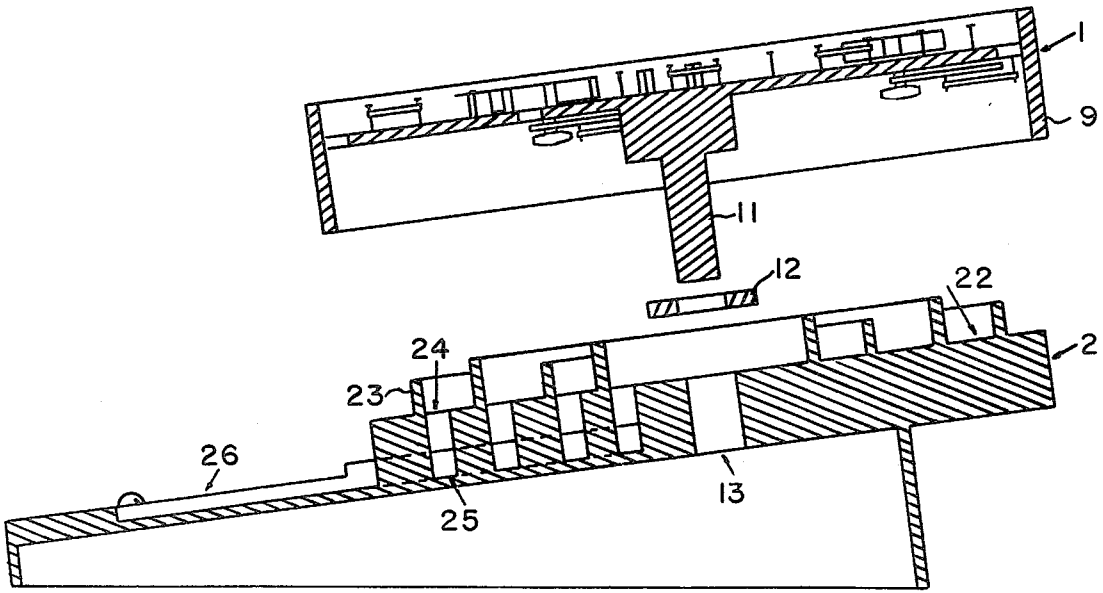
FIG. 2 is a side elevation cross section view of the game along the lines A—A of FIGS. 1 and 4.

As seen in FIG. 2, a large shaft 11 projecting downward from the center of the revolving platform, which may use a washer 12, rotates inside a bearing 13 of the stationary platform 2 which places the revolving platform at an incline.

Referring back to FIG. 1, playing balls 14 are stored in channels 15 located in the stationary platform 2. A ball is picked up from one of the channels, one channel for each player's balls, and the ball 16 is placed alongside one of the ball transporting projections 17 on the playing surface. The ball is brought up the incline by the player typically grasping the sides 9 of the revolving platform 1 and rotating the platform which moves the ball transporting projection 17 and the ball 16.

The ball then rolls down the incline of the playing surface 3. Rotating the revolving platform 1 in either direction results in the ball being redirected by means of impact with the posts 4, barriers between posts 7, target and/or trap barriers 8, and ball propellers 6.

Figure 3A:
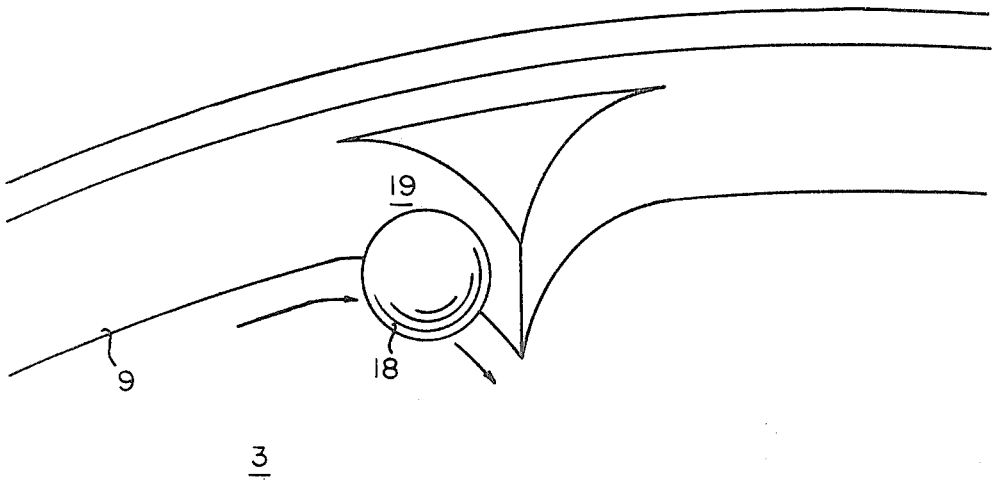
FIGS. 3A and 3B are enlarged fragment details of the game showing a guide rail in FIG. 3A and combination guide rail and ball transporting projection in FIG. 3B.
Figure 3B:
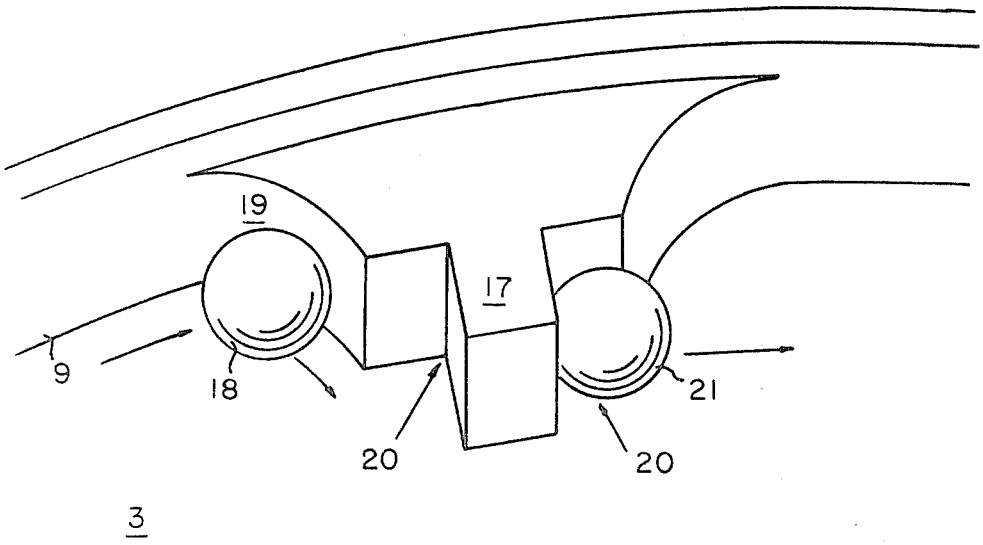
Figure 4:
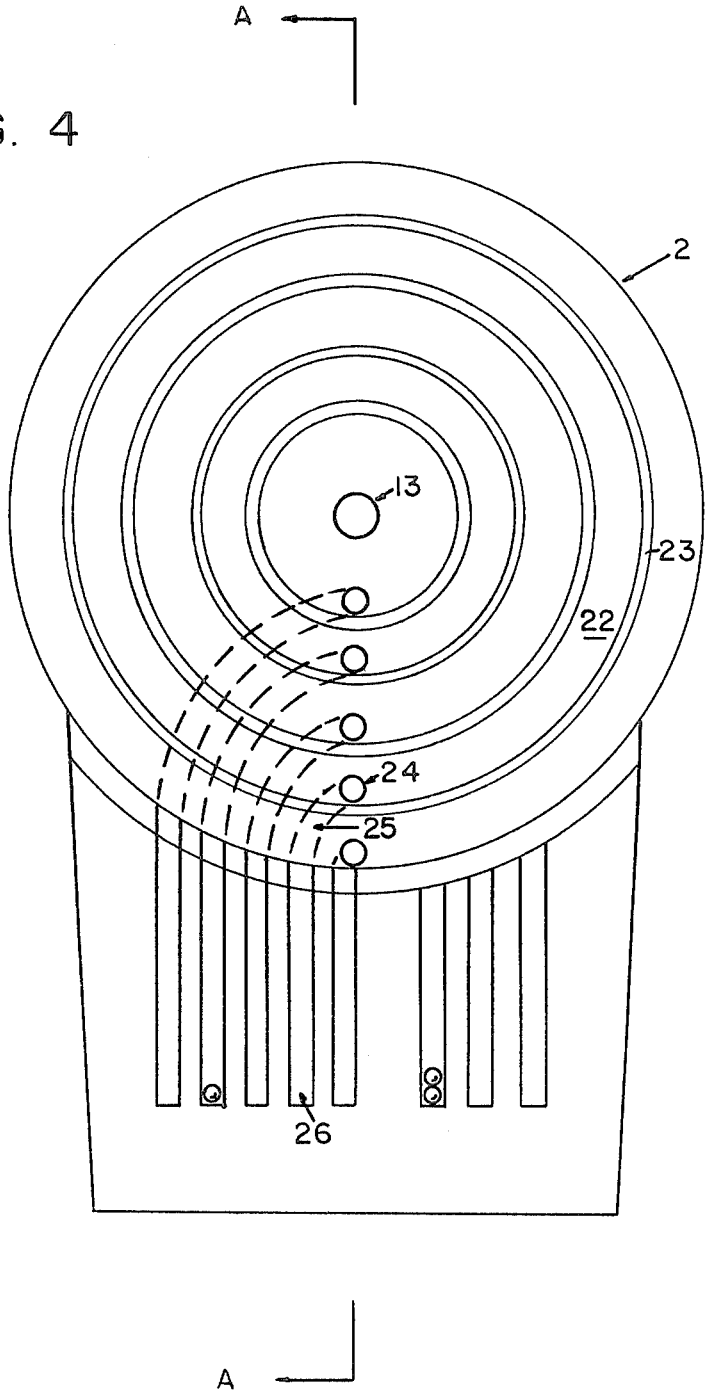
FIG. 4 is a top plan view of the stationary platform portion of the game with the revolving platform removed.

As seen in FIGS. 3A and 3B, a ball 18 rolling along the edge 9 of the playing surface 3 may be redirected toward the center of the playing surface by a guide rail 19 located on the periphery of the playing surface. The guide rail may be combined with the ball transporting projection 17 where a notch 20 in the guide rail is used to hold a ball 21 being transported near and towards the top of the inclined playing surface.

Where the targets and traps are holes, a ball which falls into a target or trap hole 5 in the playing surface 3 as shown in FIG. 1 is captured by one of the ball collecting ring channels 22 of the stationary platform 2 as seen in FIG. 4. The ring channels 22 are bounded by circular rings 23 which capture balls falling in particular target or trap holes since the holes remain at a particular radius from the center of the revolving platform 1 when the revolving platform is rotated. The edge 9 of the revolving platform 1 as seen in FIG. 2 may form the ring of the outermost ring channel of the stationary platform 2.

Since the ball collecting ring channel 22 as seen in FIG. 2 is at an angle to the horizontal, a ball dropping through a target or trap hole 5 in the revolving platform 1 as shown in FIG. 1 will drop into and roll along a ring channel 22 and then drop into another hole 24 at the lower end of the ring channel 22 as seen in FIGS. 2 and 4. After the ball drops through the ring channel hole 24, it will roll down an inclined lead channel 25 under the ball collecting channels 22 which takes the ball to a score accumulation channel 26. Each score accumulation channel corresponds to a different score.

Figure 5A:
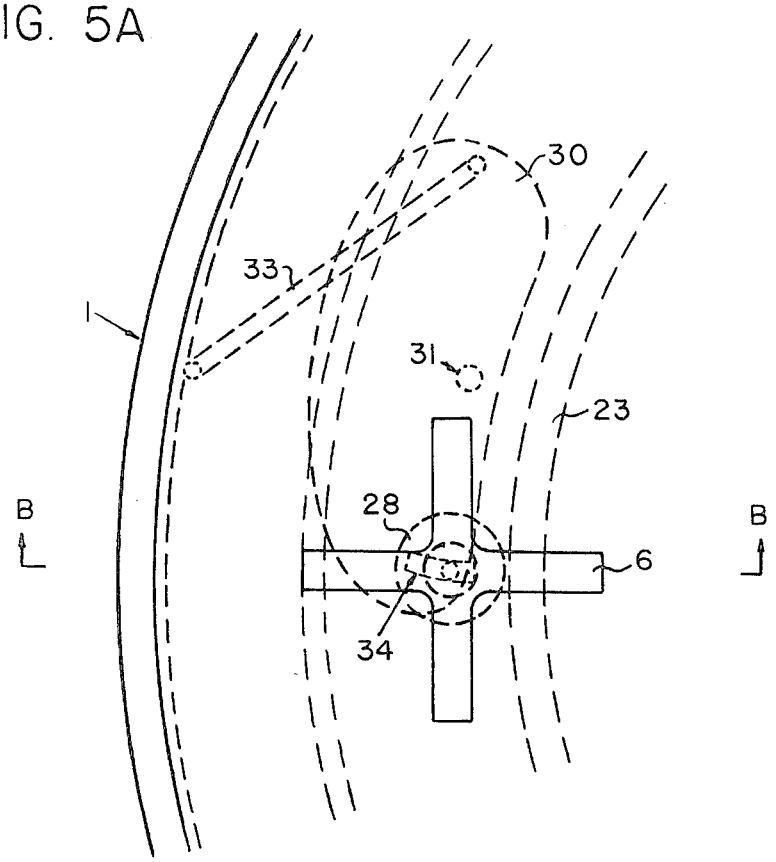
FIGS. 5A and 5B are enlarged fragment details of the game showing a ball propeller and its driving mechanism.
Figure 5B:
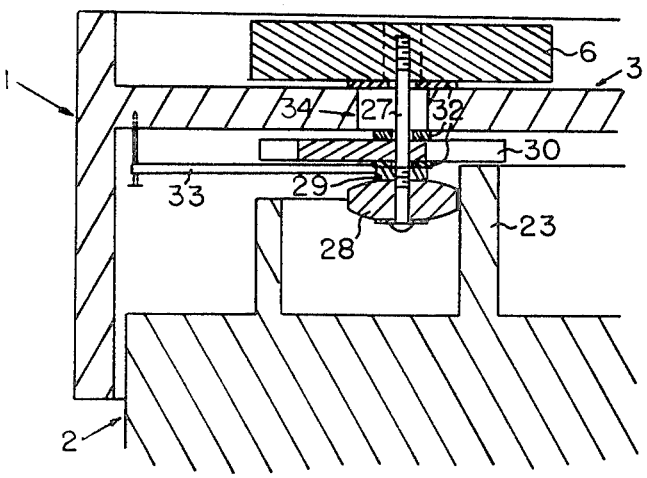

The detail of the ball propeller 6 and its mechanism is shown in FIGS. 5A and 5B. The ball propeller 6 is attached by means of a shaft 27 to a wheel 28, gear, or similar device. The wheel may be held by friction onto the shaft with a nut 29 or other appropriate means. The wheel 28 is held against one of the raised ball collecting rings 23 by means of a lever 30 pivoted 31 to the underside of the revolving platform 1. Washers 32 may be used to provide bearing surfaces as necessary. A rubber band 33, spring, or similar tensioning device is attached between the lever 30 and the revolving platform 1. A slot 34 in the playing surface 3 allows the ball propeller shaft 27, which is under tension through means of the lever 30 and rubber band 33, to bring the wheel 28 against the raised ring 23. When the revolving platform is rotated, the wheel 28 turns against the ring 23 of the stationary platform 2 causing the shaft 27 and ball propeller 6 to rotate.

The foregoing detailed description has been given for clearness of understanding only and no unnecessary limitations should be understood therefrom as some modifications will be obvious to those skilled in the art.

I claim:

1. In a pinball type game including a housing having an inclined and rotatable playing surface over which a ball may be propelled, at least one ball to be propelled on the playing surface, targets and/or traps located on the playing surface for striking by a ball, the improvement wherein a propeller on the playing surface is connected by a shaft passing through the playing surface to a wheel, gear, or similar device which is held against a raised ring under the playing surface such that when the playing surface is rotated, the wheel, gear, or similar device rolls along the ring and the propeller rotates.

2. In a pinball type game including a housing having an inclined and rotatable playing surface over which a ball may be propelled, at least one ball to be propelled on the playing surface, targets and/or traps located on the playing surface for striking by a ball, the improvement wherein one or more projections along the edge of the playing surface are used to carry a playing ball near and toward the top of the inclined playing surface by rotation of the playing surface and when the projection is near the top of the incline, the ball is released by gravity.

3. In a pinball type game including a housing having an inclined and rotatable playing surface over which a ball may be propelled, at least one ball to be propelled on the playing surface, targets and/or traps located on the playing surface for striking by a ball, the improvement wherein a guide rail located at the periphery and starting from the edge of the playing surface curves from the edge of the playing surface toward the inside or center of the playing surface to direct a fast moving ball traveling along the edge of the playing surface towards the inside or center of the playing surface or towards a ball propeller, target, trap, or other object.

4. The game of claim 1 wherein the projection which carries the ball towards the top of the inclined playing surface is located at the periphery and starting from the edge of the playing surface has a curved surface used to direct a fast moving playing ball traveling along the edge of the playing surface towards the inside or center of the playing surface or towards a ball propeller, target, trap, or other object and is notched to allow the capture of a slow moving ball or the placement of a new ball for carrying the ball toward the top of the inclined playing surface through rotation of the playing surface.

5. The game of claim 1, 3, or 2 wherein a number of projections are equally spaced on the playing surface and constructed to permit the addition of barriers between any two or more projections in the form of a line barrier between two projections or a triangular barrier system between three projections.

* * * * *